United States Patent [19]

Heltemes

[11] Patent Number: 4,752,758

[45] Date of Patent: Jun. 21, 1988

[54] DEMAGNETIZATION APPARATUS FOR MAGNETIC MARKERS USED WITH ARTICLE SURVEILLIANCE SYSTEMS

[75] Inventor: Eugene C. Heltemes, White Bear Lake, Minn.

[73] Assignee: Minnesota Mining and Manufacturing Company, St. Paul, Minn.

[21] Appl. No.: 61,545

[22] Filed: Jun. 24, 1987

Related U.S. Application Data

[63] Continuation-in-part of Ser. No. 887,721, Jul. 21, 1986, Pat. No. 4,689,590.

[51] Int. Cl.[4] ..... H01F 13/00

[52] U.S. Cl. ..... 335/284; 324/260; 361/151; 340/572

[58] Field of Search ..... 335/284, 306; 340/572; 343/787; 361/149, 151, 267; 324/259, 260, 261

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 3,790,945 | 2/1974 | Fearon | 340/280 |
| 4,003,336 | 1/1977 | Koester et al. | 361/151 X |
| 4,271,782 | 6/1981 | Bate et al. | 335/284 |
| 4,499,444 | 2/1985 | Heltemes et al. | 335/284 |

FOREIGN PATENT DOCUMENTS

| | | | |
|---|---|---|---|
| 2777884 | 5/1984 | Australia | 335/284 |
| 55180486 | 6/1982 | Japan | 335/284 |

OTHER PUBLICATIONS

Prodt. Info. Brochure from 3M entitled "Plastiform-"-Permanent Magnet Mat. Prod. No. B-1060, (Pl-1.6H).

Prodt. Info. Brochure from 3M entitled "Plastiform-"-Permanent Magnet Material Product Nos. B-1030, (PL-1.4H), B-1013, (PL-1.4H).

*Primary Examiner*—George Harris

*Attorney, Agent, or Firm*—Donald M. Sell; James A. Smith; William B. Barte

[57] ABSTRACT

A demagnetization apparatus for use with magnetically based electronic article surveillance systems having a dual status anti-theft marker containing at least one demagnetizable control element which when demagnetized allows the marker to be detected by the system when the marker is present in an interrogation zone. The apparatus includes an elongated magnetic section contained within a housing which exhibits a succession of fields of alternate polarity and a portion of which exhibits generally decreasing intensities at the working surface of the housing along that portion of the section. The peak intensity of the outermost field is controlled to have a peak intensity less than that of adjacent regions. The section and a cover plate are oriented such that the external fields near the working surface are sufficient in intensities to demagnetize the demagnetizable element of the marker positioned proximate thereto while being rapidly attenuated a short distance from the section. Accordingly, magnetically sensitive articles, such as for example, prerecorded magnetic cassettes, to which the markers are affixed, are not adversely affected.

4 Claims, 4 Drawing Sheets

DEMAGNETIZATION APPARATUS FOR MAGNETIC MARKERS USED WITH ARTICLE SURVEILLIANCE SYSTEMS

This application is a continuation-in-part of U.S. patent application Ser. No. 887,721, filed July 21, 1986, now U.S. Pat. No. 4,689,590.

FIELD OF THE INVENTION

The present invention relates to electronic article surveillance (EAS) systems of the type in which a dual status marker, affixed to articles to be protected, causes a detectable signal in response to an alternating magnetic field produced in an interrogation zone. Such a dual status marker may preferably comprise a piece of a high permeability, low coercive force magnetic material and at least one permanently magnetizable control element. When the control element is demagnetized, a detectable signal corresponding to one state of the marker may be produced when the marker is in the zone, and when magnetized, a different signal corresponding to another state of the marker may be produced. More particularly, the present invention relates to an apparatus for changing the state of such markers.

BACKGROUND OF THE INVENTION

EAS systems of the type described above, are, for example, disclosed and claimed in U.S. Pat. No. 3,665,449 (Elder and Wright). With such systems, a dual status marker of the type described above may be sensitized, i.e., the high-coercive force control elements thereof demagnetized, by applying an alternating, diminishing amplitude magnetic field, or by gradually removing an alternating field of constant intensity such as by withdrawing a bulk magnetic eraser of the type supplied by Nortronics Company, Inc. of Minneapolis, Minnesota. As disclosed in the U.S. Pat. No. 3,665,449 such a demagnetization operation may also be effected through the proper selection and arrangement of a series of permanent magnets in which adjacent magnets are oppositely polarized. By selecting the magnets to be of different strengths and by arranging them in an order ranging from highest to lowest (relative to the direction of travel), the magnetic field will appear to diminish in amplitude when passed over a control element. That patent also suggests that magnets of the same field strength may be arranged like inverted ascending steps or like an inclined plane so that the amplitude of the field is progressively diminished to produce the same result, and that it is not ordinarily necessary to demagnetize the control element in the strictest sense. Rather, the magnetic influence of the control element need only be reduced to an extent permitting magnetization reversal of the marker by the applied field.

While such techniques may be useful in many areas with the markers affixed to a wide variety of articles, the magnetic fields associated therewith have been found to unacceptably interfere with magnetic states associated with certain articles, such as prerecorded magnetic video and audio cassettes utilized in video rental businesses. Because of the compact size and popularity of such prerecorded magnetic cassettes, they are frequent targets for shoplifters, and hence likely articles with which anti-theft markers would be used. At the same time however, such affixed markers would be desirably sensitized upon return of the article, and it has been found that prior art demagnetization apparatus such as those described above may unacceptably affect signals prerecorded on the magnetic tapes within the cassettes.

SUMMARY OF THE INVENTION

In contrast to the demagnetization apparatus of the prior art acknowledged above in which the intensity of the magnetic fields produced thereby extend in a virtually uncontrolled fashion, the apparatus of the present invention provides a succession of fields of alternating polarity which rapidly decrease in intensity only a short, controlled distance from the surface of the apparatus and thus, while being capable of demagnetizing high-coercive force control elements of a marker brought close thereto, would be incapable of appreciably interfering with the magnetic signals recorded on tapes within a cassette to which the marker is affixed.

The apparatus of the present invention is thus adapted for use with an electronic article surveillance (EAS) system for detecting a sensitized dual status anti-theft marker secured to an article, the presence of which, within an interrogation zone is desirably known. The apparatus is particularly adapted for use with such a marker affixed to the outer surface of prerecorded video or audio cassettes. The marker in such a system includes a piece of low coercive force, high-permeability ferromagnetic material and at least one control element of a permanently magnetizable high coercive force material positioned proximate to the first material. Such an element, when demagnetized, results in the marker being in a first state, such as, for example, a sensitized state in which the marker may be detected when it is in the interrogation zone. Conversely, when the control element is magnetized, the marker is in a second state, such as, for example, a desensitized state in which the marker is not detected when it is in the zone.

The apparatus of the present invention comprises a housing having a working surface relative to which the article may be moved and an elongated section of a permanent magnetic material associated with the housing. The elongated section has a plurality of alternately polarized permanently magnetized regions successively extending along the length of the section. The regions exhibit at the working surface of the housing a succession of closely spaced fields of alternating polarity. A first portion of the elongated section exhibits at the working surface fields of generally decreasing intensities along that portion of the elongated section. Each region extends across the width of the elongated section and the succession of regions extends along the length of the elongated section. In addition, the field intensity at the working surface associated with the most intense region in the succession is approximately one and one half times the predetermined value of coercive force of the control element. Thus, movement of the article relative to the working surface from a position adjacent the most intense field past each successively weaker field of opposite polarity will expose the marker affixed thereto to fields of alternate polarities and gradually decreasing intensities to substantially demagnetize the control element of the marker. The close spacing of the alternate regions results in a rapid decrease in intensity of the fields above the working surface so as not to adversely affect a magnetically sensitive object contained within the article.

In particular, in the present invention, the elongated section also includes a second portion associated with that end of the first portion which exhibits the most intense field at the working surface of the housing. This second portion includes a succession of alternately polarized permanently magnetized regions of approximately equal peak intensities, and an outermost region having a peak intensity less than that of the other regions. Such a structure ensures that the peak intensity at the working surface of the outermost field is not greater than that associated with the other regions.

The net field at any position along the working surface is the algebraic sum of the flux from each of the magnetized regions of the elongated strip positioned below the surface, with each region having a lesser effect depending upon the distance of that region from the given position. Thus, for example, the net field at a position midway along the working surface will be in the direction dictated by the magnetized region directly therebelow, and the peak intensity will be reduced primarily by the opposing fields of the immediately adjacent regions of equal intensity. In contrast, if the outermost region were to provide a field of equal intensity with that provided by the remaining regions, the absence of a yet further out field of opposite polarity would cause the intensity of the outermost field at the working surface to be greater than that resulting from the remaining regions. Such a larger field could adversely affect prerecorded magnetic media positioned along the working surface. Conversely, if the initial peak field intensity is controlled to be below that at which such adverse effects may occur, the subsequent even smaller fields associated with the rest of the second portion may not be adequate to completely demagnetize the control elements such that the resultant sensitivity is diminished.

BRIEF DESCRIPTION OF THE DRAWINGS

The present invention will be more fully described with reference to the accompanying drawings wherein like reference numerals identify corresponding components, and.

DESCRIPTION OF THE PREFERRED EMBODIMENT

Figure 1:
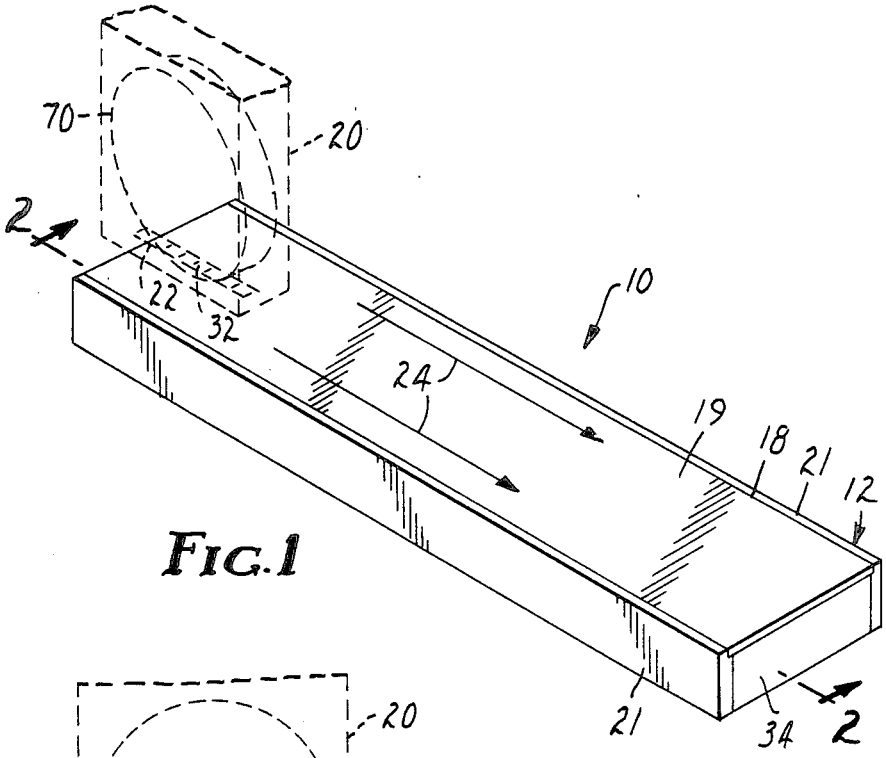
FIG. 1 is a perspective view of one embodiment of the demagnetization apparatus of the present invention.
Figure 2:
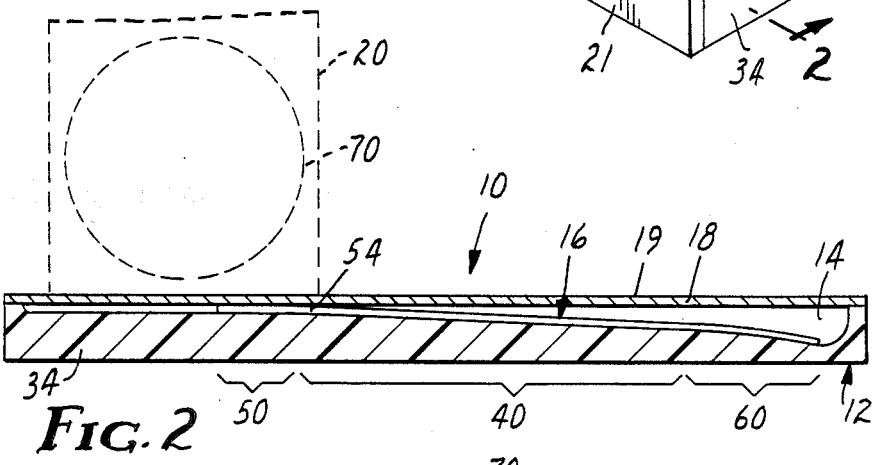
FIG. 2 is an enlarged cross sectional view of FIG. 1, taken along the lines 2—2.

As shown in FIGS. 1 and 2, the demagnetization apparatus of the present invention may be in the form of a counter top apparatus 10 having a housing 12, and contained within a cavity 14 therein an elongated magnetic section 16 as described hereinafter. The cavity 14 is in turn covered by a non-magnetic cover plate 18 which both covers and protects the elongated magnetic section 16. In addition, the cover plate 18 provides a working surface 19 over which an article 20 having a marker 22 affixed thereto may be passed during the use of the apparatus. For example, such a cover plate 18 may comprise a strip of non-magnetic stainless steel having a thickness in the range of 20 mils (0.50 mm). The use of a metallic cover plate 18 is further desired as such a surface resists wear from scratching or chipping as may otherwise occur with cover plates having a polymeric or painted surface, and it thereby remains aesthetically acceptable even over many cycles of use.

While the apparatus 10 may be used with the working surface 19 established by the cover plate 18 in a horizontal position, such that an article 20 may be moved across the horizontal surface, the apparatus may also be positioned to have the working surface 19 vertical.

The housing 12 of the apparatus 10, as shown in FIG. 1, includes two sides 21. The housing is preferably constructed of non-magnetic materials, and may be fabricated from appropriately dimensioned and finished hardwood, or may be formed from injection molded or machined plastic. Also, beveled faces (not shown) may be provided on the housing 12 to carry appropriate legends, manufacturer identification, instructions and the like.

In using the apparatus of FIG. 1, it will be recognized that the article 20 is to be moved in the direction shown by arrows 24, thus causing the marker 22 affixed to one surface of the article to be moved so that the marker 22 is passed over the elongated magnetic section 16 contained within the cavity 14. Thus, for example, if the article 20 is a typically packaged video cassette, the marker 22 could be affixed to one side of the cassette, and the cassette held so as to be positioned on the cover plate 18 and passed along the working surface 19 in the direction of arrows 24.

The marker 22 is typically constructed of a strip of a high permeability, low coercive force magnetic material such as a permalloy, certain amorphous alloys, or the like as disclosed, for example, in U.S. Pat. No. 3,790,945 (Fearon). The marker is further provided with at least one control element 32 of a high coercive force magnetizable material as disclosed, for example, in U.S. Pat. No. 3,747,086 (Peterson). The control element 32 is typically formed of a material such as vicalloy, magnetic stainless steel or the like, having a predetermined value of coercive force in the range of 50 to 240 oersteds. When such an element is magnetized, it prevents the marker from being detected by the system when the marker 22 is present in the interrogation zone.

The demagnetization of the control element 32 is effected upon exposure to the fields provided by the elongated magnetic section 16 when the element 32 is brought into close proximity with the magnetic fields associated with the section 16 at the working surface 19.

The details of the elongated magnetic section 16 are shown in the cross sectional view of FIG. 2. As may there be seen, the housing 12 of the apparatus 10 is shown to have a recess or cavity 14 within which the elongated magnetic section 16 may be positioned and supported by the housing within the recess, or by a frame 34 with the top of the recess enclosed by the cover plate 18. As an alternative, the section may be held in position within the recess 14 by the cover plate 18 (not shown).

Figure 3:
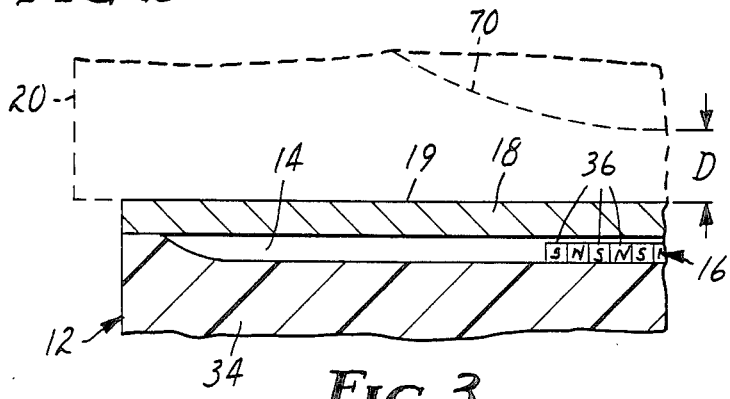
FIG. 3 is an enlarged fragmentary cross sectional view of the details of the elongated magnetic section of FIG. 2.

As shown in FIG. 2 and in greater detail in FIG. 3, the elongated magnetic section 16 has a plurality of poles 36 in a succession of closely spaced fields of alternate polarity and of generally equal intensity from one end of the elongated magnetic section 16 to the other. Each pole 36 extends across the width of the section 16, and the succession of poles extends along the length of the section 16. The elongated magnetic section 16 may be made of: (1) an injection molded permanent magnet material, such as type B-1060 "Plastiform"Brand sold by 3M Co., St. Paul, Minnesota, which is subsequently magnetized after molding and arranged with alternating poles; or (2) a sheet material magnetized with uniform alternating poles, such as type B-1013 "Plastiform"-Brand sold by 3M Co., St. Paul, Minnesota. In the illustrated embodiment, the elongated magnetic section 16 was formed of a 0.090 inch thick and 3.0 inch wide sheet material of the type described above magnetized with six poles per inch.

The bottom of the recess 14 on which the magnetic section 16 is positioned is inclined with respect to the working surface 19 of the housing 12 so that a first portion 40 of the section 16 exhibits magnetic fields of generally decreasing intensity at the working surface of the housing. A second portion 50 is provided adjacent to the most intense field end of the first portion 40 and planar to the working surface 19 of the housing. The second portion 50 includes more than one pole and provides alternating fields of fairly constant peak intensities at the working surface 19 of the housing. The purpose of the second portion 50 is to assure at least one intense field in a direction opposite to the magnetization of the control element 32 in order to properly begin the demagnetization process. The second portion 50 also serves to eliminate any end effects associated with the first pole 54 of the first portion 40 having the most intense field associated therewith. In addition, the low field end of the elongated magnetic section 16 includes a third portion 60 curved for the purpose explained hereinafter.

Figure 4:
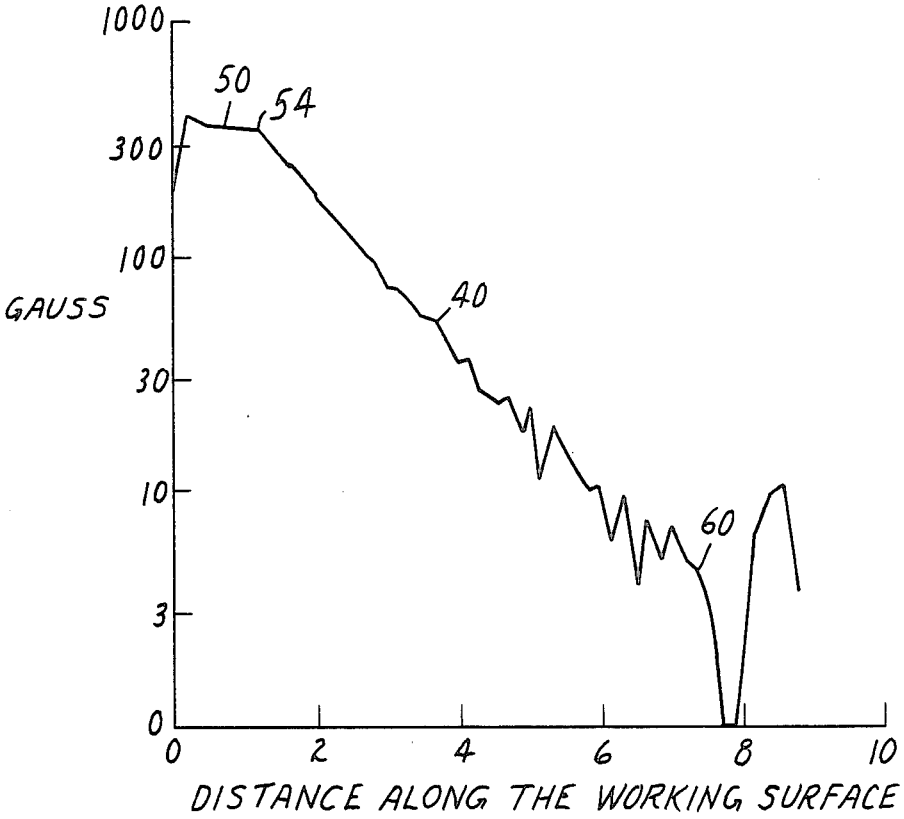
FIG. 4 is a graph illustrating field strength along the working surface for a specific embodiment.

Thus, it has been found that by supporting the above magnetic section having six poles per inch on a frame 34 as illustrated in FIGS. 2 and 3 having a second portion 50 of 1.0 inch, a first portion 40 of 6.0 inches inclined at 2. 23" to the working surface 19 of the housing, and a third portion 60 of 2.0 inches having a radius of 12.2 inches, the poles will exhibit peak fields along the working surface as illustrated in FIG. 4, it being recognized that the alternations of magnetic polarity between each adjacent pair of poles actually results in a generally sinusoidal variation in the horizontal field along the working surface.

It is believed that the increase in field intensity at the end of the third portion 60 as shown in FIG. 4, is the result of the fact that the field at the working surface 19 above the last pole is not subjected to a compensating field from an adjacent pole of opposite polarity. It is essential that this increased field be sufficiently small so as not to allow partial remagnetization of the control element 32. Thus, it has been found that the third portion 60 having an arcuate curve away from the working surface provides a more rapid increase in the distance from the working surface so that a sufficiently low field will be exhibited at the working surface above the last pole to minimize any affect on the control element 32. It should be appreciated that the third portion may alternatively be inclined at a steeper angle of incline than the first portion 40. However, by utilizing an arcuate curve a smoother transition is provided between the first portion 40 and the third portion 60.

As illustrated in FIG. 4, the decrease in intensity is non-uniform. This is believed to be the result of small variations in size and magnetization of different poles. However, such minor irregularities can be tolerated so long as the variations are not large enough to prevent demagnetization of the control element 32. If the fields were to decrease too slowly, the elongated section 16 would need to be impractically long, and if the fields were to decrease too rapidly, the demagnetization would not be complete, especially in view of the non-uniformities as mentioned above. Thus, demagnetization will occur if on the average the field intensity at the working surface 19 associated with each successive pole decreases by 5 to 20 percent between any two adjacent poles.

It is critical that the field associated with the most intense pole be strong enough to start the demagnetization process. This has been found to equal approximately one and one half times the predetermined value of coercive force of the control elements. However, it is also critical that the field intensity not be strong enough to adversely affect a magnetically sensitive object 70 contained within the article 20 during demagnetization of the control elements. Prerecorded audio cassettes are adversely affected by magnetic fields greater than about 100 oersteds while prerecorded video cassettes can withstand higher fields, perhaps as much as 200 oersteds. It is necessary that the fields of the demagnetization apparatus decrease rapidly away from the working surface 19 so as to be sufficiently small at a distance D measured from the working surface 19 to the magnetically sensitive object 70. A typical distance D is within the range of 1/16 to ⅛ of an inch. This is accomplished by keeping the pole spacing small enough so that away from the surface, different poles contribute to the effective field, resulting in partial cancellation from adjacent poles of opposite polarity. At the same time, the pole spacing must not be too small or the fields at the surface will not be intense enough to start the demagnetization process. Thus, to demagnetize the control element 32 of the affixed marker 22 without adversely affecting a prerecorded cassette, a field intensity of no more than 450 oersteds, preferably in the range of 350–420 oersteds at approximately 0.030 inch above the working surface with a pole spacing of 6 or 7 poles per inch is preferred.

As shown in FIG. 4, the initial peak field resulting from the outermost pole of second portion 50 may be somewhat greater than that produced by the remainder of the poles in that portion. A number of field reversals along the second portion 50 are desirable in order to ensure that the magnetization states of the control elements 32 within a marker are reversed at least once before the field gradually decreases. Thus each of the successive fields of fairly constant peak intensities and successively alternating polarities along that portion must have an intensity close to the maximum allowable without adversely affecting prerecorded magnetic media to be positioned along the working surface. The presence of an initial peak field of yet greater intensity than that along the remainder of the second portion can thus give rise to different problems. First, if the peak fields along the remainder of that portion are already close to the maximum allowable level, a first peak of still greater intensity will be much more likely to adversely affect prerecorded media. On the other hand, if all of the intensities are reduced proportionately so that the outermost peak field intensity is within the maximum allowable level, the intensities of the subsequent fields may be too low to initiate proper demagnetization cycles, and the control strips may then not become completely demagnetized.

While it is possible to control both the initial peak field so that it is not too high, and the subsequent fields so that they are not too low, normal manufacturing tolerances make this difficult. For example, if peak intensity of the outermost region of the second portion is made, via appropriate selection of the magnetic strip, to have a nominal intensity of about 400 oersteds, typical variations due to manufacturing tolerances will result in some peak field intensities being sufficiently high so as to adversely affect prerecorded media. Conversely, if the nominal intensity is decreased to about 360 oersteds so that the peak field experienced with typical manufacturing tolerances is below that found to adversely affect such recorded media, the minimum peak fields associated with the remainder of the second portion may be too low to begin a complete magnetization reversal. The control elements of some markers may then be ultimately left in a non-completely demagnetized state and full sensitivity may not be restored.

With a construction producing fields having the intensities as shown in FIG. 4, (i.e., an outermost peak field intensity of about 380 oersteds and an average peak intensity of about 320 oersteds along the remainder of the second portion) markers were demagnetized satisfactorily. When the average peak fields were decreased by only 20 oersteds, it was observed that the sensitivity of about half of the markers after being passed along the entire working surface, was only about 95% that observed when higher fields were used.

Figure 5A:
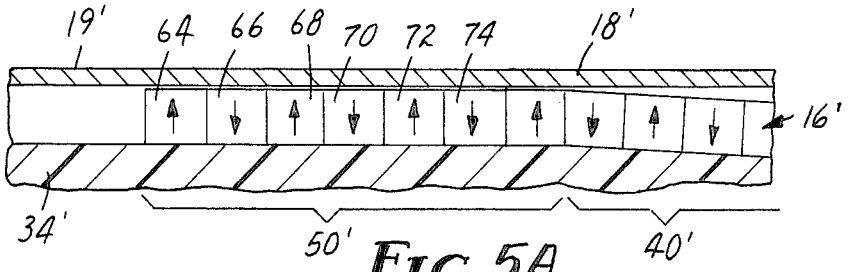
FIG. 5A is a further enlarged fragmentary cross-sectional view of the details of the second portion of the elongated magnetic section of FIG. 3.

FIG. 5A is a cross-sectional view of a construction in which such an undesirably high initial peak field was observed. Within the frame 34' was positioned a magnet strip 16' having the first (40'), second (50') and third portion (not shown) as previously described. Only a part of the first portion 40' and the second portion 50' are actually shown in FIG. 5A. Such a strip 16' was desirably formed of narrow, discrete sections 64, 66, 68, 70, 72 and 74 of Plastiform Brand permanent magnet material. Thus, 0.125" thick, 0.143" long and 3" wide pieces were injection molded using appropriate fixtures, the 0.143" length being selected so that when the pieces are subsequently assembled side-by-side, a pole spacing of 7 poles per inch is obtained. After molding, the discrete pieces were exposed to a constant intensity magnetic field, thus producing a very uniform level of magnetization in each piece in which the tops of the pieces had a first magnetic polarity and the bottoms had the opposite polarity. The pieces were then assembled, with alternate pieces positioned upside down, and a cover plate 18' added, to provide a succession of alternating fields at the working surface 19'. Such an assembly of discrete pieces has been found to provide a more uniform succession of alternate polarity fields of either constant or regularly decreasing intensity.

As shown in FIG. 5A, the second portion 50' was constructed of pieces all of which were of the same width and magnetic intensity. With such a construction, the net direction and intensity of the field at any given location along the working surface is primarily controlled by the magnetized pieces directly below that location, and will be secondarily reduced by the opposing fields of the next closest pieces. However, as the field primarily associated with the outermost magnetized piece 64 is not compensated, i.e., reduced by an opposing field from a yet further out magnetized piece the initial peak field intensity may be greater than that resulting from the remainder of that portion.

Figure 5B:
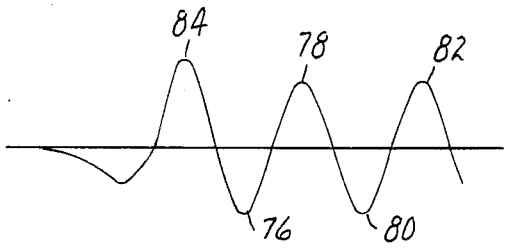
FIG. 5B is a graph illustrating the variations in horizontal field intensity at the working surface corresponding to the structure shown in FIG. 5A.

Such a result is shown in FIG. 5B. The positive and negative peak horizontal field components 76, 78, 80 and 82 are there shown to occur at positions above the boundaries of each of the adjacent pieces, and as each is fully compensated, are of uniform intensities. In contrast, the first peak 84, being uncompensated, has a higher intensity.

Figure 6A:
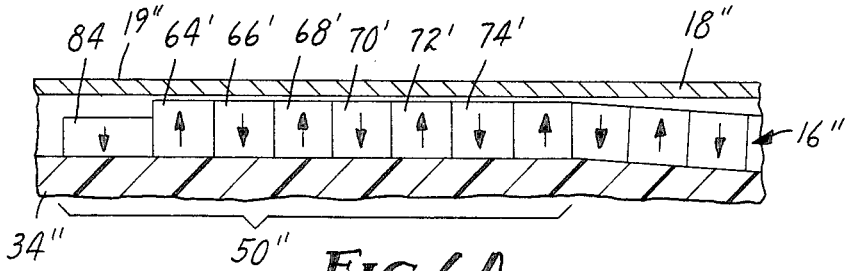
FIG. 6A is a similarly enlarged fragmentary cross-sectional view of the details of a preferred second portion of the elongated magnetic section according to the present invention.
Figure 6B:
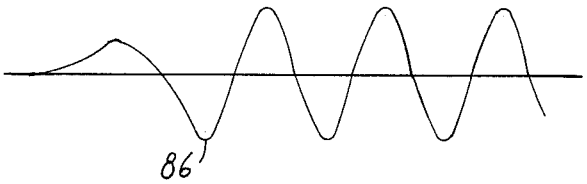
FIG. 6B is a graph illustrating the variations in horizontal field intensity at the working surface corresponding to the structure shown in FIG. 6A.

In a preferred embodiment, such higher initial intensities may be prevented by including a yet further out magnetized region of lower field strength. Such an embodiment is shown in FIG. 6A, with the resultant field intensities set forth in FIG. 6B. As there shown, the second portion 50" still includes a plurality of magnetized pieces, 64', 66', 68', 70', 72', and 74' just as described above. To such an assembly was added an outer piece 84 which was 0.090" thick, and which was slightly larger, i.e., 0.20" long in the direction of the assembled strip. This piece was then magnetized top-to-bottom in the same manner as that of the other pieces, the resultant intrinsic field intensity provided by that piece being about one-half that provided by each of the other pieces. The bottom of the piece 84 was positioned coplanar with the remaining pieces, i.e., the top was further from the working surface 19". The overall construction and placement were thus selected so that, as shown in FIG. 6B, the initial peak field intensity 86 was not greater than that of the remaining peak intensities. With such a construction, complete demagnetization of all tested markers was found to result, so that 100% of initial sensitivity was restored.

Figure 7:
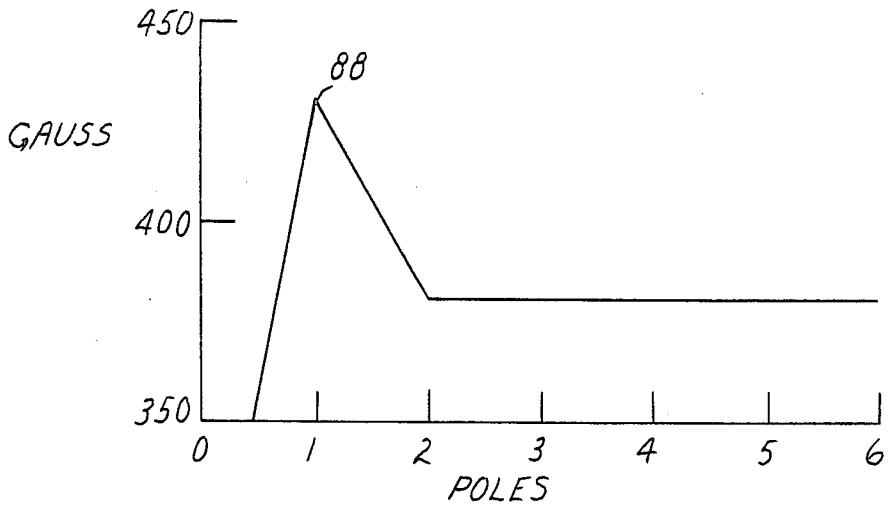
FIGS. 7 and 8 are stylized graphs illustrating the peak field strengths along the working surface associated with second sections of the elongated magnetic section constructed as shown in FIGS. 5A and 6A, respectively.
Figure 8:
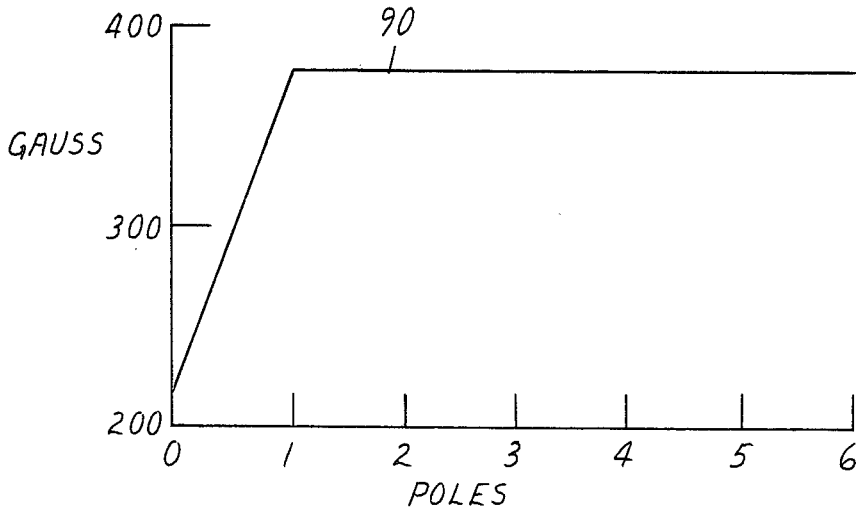

FIGS. 7 and 8 further set forth the peak field intensities resulting when such an additional piece with lower peak field intensity is not present (FIG. 7) and when it is present (FIG. 8). As shown in FIG. 7, if the field along most of the portion 50 is selected to be about 380 oersteds so as to appropriately condition the control elements of the markers, the initial field 88 may exceed 430 oersteds, and thus may adversely affect recorded media. Instead, as shown in FIG. 8, the addition of another, lower strength magnetized piece eliminates such an initial peak and allows the intensities 90 along the entire portion to be optimized.

In the embodiment described above with reference to FIGS. 5A, 5B, 6A, 6B, 7 and 8 the permanently magnetized elongated section having first, second and third portions, 40, 50 and 60 respectively, were formed of discrete separate pieces, which after being magnetized, were then placed side by side to form the elongated section. In other embodiments, such as those described in conjunction with FIGS. 1–4, the section may be formed of one or more extruded pieces in which each piece is magnetized with a succession of poles of alternate polarity. Accordingly, in the preferred embodiment in which the outermost pole is to provide a less field, the region or piece associated with that pole can be configured to achieve that result in various ways. The region or piece itself can be smaller, it can be positioned further away from the working surface, and it can be intrinsically weaker, either by being formed of a less strong magnetic composition, or by being magnetized to a less intense state. Similarly, the outermost net field at the working surface may be reduced by including a magnetic shim to partially shunt the field from the magnets below the surface. Other, analogous techniques to reduce the intensity of the outermost field are likewise within the scope of the present invention.

I claim:

1. An apparatus which in movement relative to an article, having affixed thereto a dual status anti-theft marker including at least one remanently magnetizable control element having a coercive force of a predetermined value, demagnetizes said control element to change the status of the marker, said apparatus comprising:

a housing having a working surface relative to which an article may be moved, and an elongated section of permanent magnetic material associated with said housing, said elongated section having a succession of alternately polarized permanently magnetized regions extending along the length of the section, each of which regions extends across the width of said section, said regions exhibiting at the working surface a succession of fields of alternating polarity, wherein said section has a first portion which exhibits at the working surface fields of generally decreasing intensities to thereby expose a said marker affixed to a said article moved along said length to fields of alternate polarities and generally decreasing intensities and thereby substantially demagnetize the control element of said marker, and wherein said section further comprises a second portion associated with that end of said first portion which exhibits the most intense field at the working surface of said housing, said second portion including a succession of alternately polarized permanently magnetized regions of approximately equal peak intensities and an outermost region having a peak intensity less than that of the other regions, thereby ensuring that the peak intensity at the working surface of the outermost field is not greater than that associated with the other regions.

2. An apparatus according to claim 1, wherein said outermost region extends approximately parallel to the working surface and at about the same height relative thereto as the remainder of the second section, and has an intrinsic field intensity approximately one-half that provided by the remainder of the regions thereof.

3. An apparatus according to claim 1, wherein said elongated section of permanent magnet material has substantially the same composition throughout and the outermost region of said second portion thereof comprises a piece of said material of smaller dimensions than that associated with each pole in the remainder of the section.

4. An apparatus according to claim 1, wherein said elongated section comprises an assembly of discrete pieces of permanent magnetic material, each piece other than an outermost piece being magnetized to provide substantially the same intrinsic field intensity, and the outermost piece being magnetized to provide a peak intensity less than that provided by the other pieces.

* * * * *